US005187965A

United States Patent [19]

Figge et al.

[11] Patent Number: 5,187,965

[45] Date of Patent: Feb. 23, 1993

[54] ROLL STAND FOR A PLANETARY ROLLING MILL

[75] Inventors: Dieter Figge; Peter Fink, both of Essen, Fed. Rep. of Germany

[73] Assignee: Mannesmann Aktiengesellschaft, Dusseldorf, Fed. Rep. of Germany

[21] Appl. No.: 714,277

[22] Filed: Jun. 12, 1991

[30] Foreign Application Priority Data

Jun. 15, 1990 [DE] Fed. Rep. of Germany ..... 4019562

[51] Int. Cl.[5] ..... B21B 13/20

[52] U.S. Cl. ..... 72/190; 72/241.8

[58] Field of Search ..... 72/190, 241.8, 241.4

[56] References Cited

U.S. PATENT DOCUMENTS

| | | | |
|---|---|---|---|
| 1,614,425 | 1/1927 | Coe | 72/241.4 |
| 2,975,663 | 3/1961 | Platzer | 72/190 |
| 2,978,933 | 4/1961 | Sendzimir | 72/190 |

*Primary Examiner*—Lowell A. Larson

*Attorney, Agent, or Firm*—Cohen, Pontani, Lieberman, Pavane

[57] ABSTRACT

The present invention relates to a roll stand for a planetary rolling mill having roll housings, stationary support bodies which are mounted on insert pieces, which have at least one rolling segment inserted therein, with hardened segment inserts, and intermediate and work rolls mounted in cages and rotating around the support bodies. Upon their rotation around the support bodies, these rolls are brought against the intermediate rolls and the latter are brought against the support bodies. The rolling surface of the rolling segments is formed by the segment inserts which have a flattened cross-sectional shape, in the region of the shaping zone, differing from the circular cross sectional shape of the support bodies having a rolling surface which can vary in position with respect to the support body by displacement of the segment inserts, individually or in groups, in a direction perpendicular to the axis of the support body.

11 Claims, 5 Drawing Sheets

ROLL STAND FOR A PLANETARY ROLLING MILL

FIELD OF THE INVENTION

The present invention relates to a roll stand for a planetary rolling mill having roll housings, stationary support bodies which are mounted on insert pieces, which have at least one rolling segment inserted therein, with hardened segment inserts, and intermediate and work rolls mounted in cages and rotating around the support bodies. Upon their rotation around the support bodies, these rolls are brought against the intermediate rolls and the latter are brought against the support bodies. The rolling surface of the rolling segments is formed by the segment inserts which have a flattened cross-sectional shape, in the region of the shaping zone, differing from the circular cross sectional shape of the support bodies.

BACKGROUND OF THE INVENTION

Planetary rolling mills of the type described above have been previously known. However, these known types of rolling mills do not provide for effecting control of the flatness of the strip to be rolled. This is particularly important because the there is an increasing demand for strips with a high degree of flatness and a smaller thickness tolerance over the length of the hot rolled sheet.

Flatness defects which are evident after the rolling process, as is known, are essentially due to different stretching conditions over the width of the strip due to nonuniform shaping of the strip in the roll nip. These defects are noticeable as local undulations in the strip, occurring either at the edges of the strip or in the center thereof.

In conventional roll stands, control of the flatness is effected in various ways, primarily by mechanical or thermal measures. Known proposals contemplate, for instance, a barreling of the rolls directed in the directed opposite the sag of the rolls under load, while other solutions operate with a pair of rolls in which the rolls swing against each other or with bending means which act on the rolls.

Insufficient flatness of the strip results if a change in the profile shape takes place upon rolling a starting cross section to a final cross section. This can be remedied by applying tension to the strip, whereby the strip is subject to plastic deformation forces, as a result of which the undulations produced by deficiencies in flatness disappear. Such plastic deformation, however, also changes the thickness of the strip and thus leads to a poorer thickness tolerance. In other words, thickness variations may be reduced by stretching the strip, but this also results in a narrowing of the strip.

SUMMARY OF THE INVENTION

Starting from the known problems of deficiencies of flatness of strips processed on roll stands of conventional construction, an object of the present invention is to provide for the possibility of regulating the flatness of strips produced in roll stands of the above-described type.

It is proposed, in accordance with the invention, that, in a planetary rolling mill, the position of the rolling surface with respect to the support body be variable by displacement of the segment inserts, individually or group-wise, in a direction perpendicular to the axis of the support body.

The position of the rolling surface is changed depending on the flatness of the strip emerging from the roll stand, measured in a conventional manner. After evaluation of the measured flatness value, in the event that deviation from the desired value is found, a signal is transmitted to setting members in the roll stand which are force-actuated, and change the position of the rolling surface with respect to the support body. In this way an elastic deformation of the intermediate rolls and of the working rolls is positively effected, as a result of which the desired contour can be established on the strip. The correction may be extremely slight; it is effected in amounts of, for instance, from about 0.01 to about 0.05 mm.

This invention takes into account the special nature of the design of a planetary rolling mill of this type, in which the working and intermediate rolls roll on the stationary support body and are forced, within the shaping zone and as a result of the specially shaped rolling segments or their segment inserts, to move over a linear path on the rolling surface formed by the inserts. In this way, the bead of material being rolled is rolled out into a flat strip in front of the working rolls. The segment inserts are equal in number to the number of support points at which the rolling forces are transmitted from the working roll, via the intermediate rings of the intermediate roll, to the support body. A plurality of support surfaces form the rolling surface for the intermediate rolls. If the position in space of the rolling surface, i.e. the support points, is changed, then the sag of the work roll is changed. By carefully controlling the displacement of the rolling surface, the sag of the work roll may be controlled in the desired manner to compensate for the surface undulations of the work piece.

The displacement of the rolling surface can be effected in various ways. Thus, in accordance with one feature of the invention, it is proposed that the back side of each segment insert facing the axis of the support body have a wedge-shaped surface which is forced against a wedge surface which is functionally associated with the support body. The wedge surfaces are displaceable relative to each other in the direction of ascent of the wedge surfaces and are adapted to be locked in any desired displaced position.

In one embodiment of the proposal, it is provided that for the displacement of the wedge surfaces towards each other in the direction of displacement, hydraulic piston-cylinder units be provided on both sides of the rolling segment, against which units the segment inserts can be clamped hydraulically in different displaced positions. Clamping cylinders for the clamping of the segment inserts may be associated with the hydraulic cylinders which serve for the movement. The displacement amounts to only a slight amount, about 1 to about 3 mm. Upon the displacement, the highest point of the rolling surface travels in accordance with the displacement of the segment; if all segments are displaced simultaneously, the bend of the working roll does not change; if only a few segments are displaced in a targeted manner, the working roll is imparted with the desired bend.

In another embodiment of the solution of the invention, it is proposed that the front and ends of the segment inserts, as seen in the direction of rolling of the work rolls, be beveled in planes converging with respect to each other, which are parallel to the axis of the support body, and that the wedge surfaces of respective wedges rest against these planes. The wedge surfaces are displaceable parallel to the end planes by displacement of the wedges in alternate directions and the segment insert can be clamped by displacement of the wedges in the same direction. This solution has the advantage of providing a better arrangement of the displacement drives since a deflection of the adjustment forces can be effected by the wedges.

In one embodiment of the invention, the segment inserts can be inserted in a recess in the rolling segment and can be adapted to be raised and lowered via hydraulically-actuated wedges, the rolling segment being arranged in the support body.

In another embodiment of the invention, a plurality of wedge surfaces, which are moveable synchronously in the same direction and arranged alongside of each other, are associated with each segment insert, the wedge inclination extending transverse to the direction of rolling. The wedge surfaces of adjacent segment inserts are preferably arranged one behind the other on a common wedge. For adjusting the profile or the sag of the work rolls, the wedge surfaces which are arranged one behind the other may have different inclinations which correspond to the desired profile of the working roll.

In a further embodiment in accordance with the invention, it is provided that the rolling surface of the intermediate rolls on the segment inserts is curved transverse to the direction of rotation of the work rolls. The curvature may preferably be either convex or concave. In this embodiment, the segment inserts are so ground that the rolling surfaces imposes the desired sag, corresponding to the desired profile of the strip, on the intermediate rolls and thus also on the work rolls.

BRIEF DESCRIPTION OF THE DRAWINGS

The preferred embodiments are shown by way of example in the accompanying drawings in which.

DETAILED DESCRIPTION OF THE PRESENTLY PREFERRED EMBODIMENTS

Figure 1:
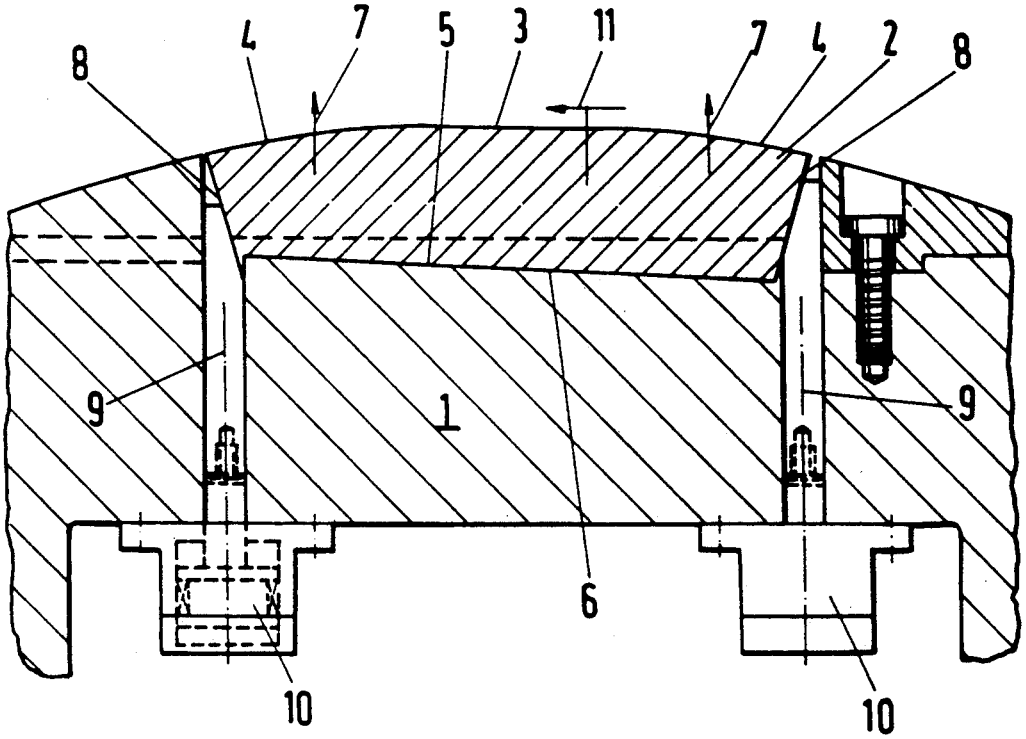
FIG. 1 shows an embodiment of the invention with wedge displacement.

In FIG. 1, 1 is a part of the support body in which a plurality of segment inserts 2, arranged spaced alongside of each other are inserted. The segment inserts 2 have in the region of the rolling surface indicated at 3 a flattened cross-sectional shape differing from the circular shape 4. The flattened cross-sectional shape of the rolling surface of the segment inserts 2, indicated at 3, is necessary for the rolling process but does not form part of the present invention.

In accordance with the invention, the position of the rolling surface 3, 4 which is defined by the surfaces of a plurality of adjacent segment inserts on which the intermediate rolls roll can be changed by displacement of the segment inserts 2, either individually or in groups, in a direction perpendicular to the axis of the support body.

In the embodiment shown in FIG. 1, the rear of each segment insert 2 facing the axis of the support body has a wedge surface 5 which rests in force-locked manner, i.e. it is locked in place by frictional forces, on a wedge surface 6 which is functionally associated with the support body. By displacement of the segment insert 2 with respect to the wedge surface 6, the vertical position of the segment insert is changed in the direction indicated by the arrow 7.

For the displacement process, which is described below, the front and rear ends 8 of the segment inserts 2, as seen in the rolling direction of the work rolls, are beveled in planes convergent to each other. Against each of these planes there rests an adjustment wedge 9 which is displaceable parallel to the direction of the arrow 7 of the segment inserts 2 by means of a piston-cylinder unit 10. The adjustment wedge 9 is provided, in the region of the beveled ends 8 of the segment inserts 2, with wedge surfaces which rest against them and which effect a deflecting of the displacement force from the piston-cylinder units 10 in the direction of displacement 11 of the segment inserts 2. In the manner that the one adjustment wedge is moved downward in the plane of the drawing and the other adjustment wedge is moved upward in the plane of the drawing, the segment insert 2 is displaced in the direction 11. A reverse actuation of the adjustment wedges 9 moves the segment insert 2 in the opposite direction. Since the segment insert 2 rests on the wedge surface 6, a movement to the left means a lifting of the segment 2 upwards and a movement to the right a lowering downwards. If both displacement wedges 9 are moved upward, then the segment inserts are clamped between the wedges. Of course, the segment inserts 2 are so guided on the support body 1 that they are secured against being lifted out of the support body 1.

Figure 2:
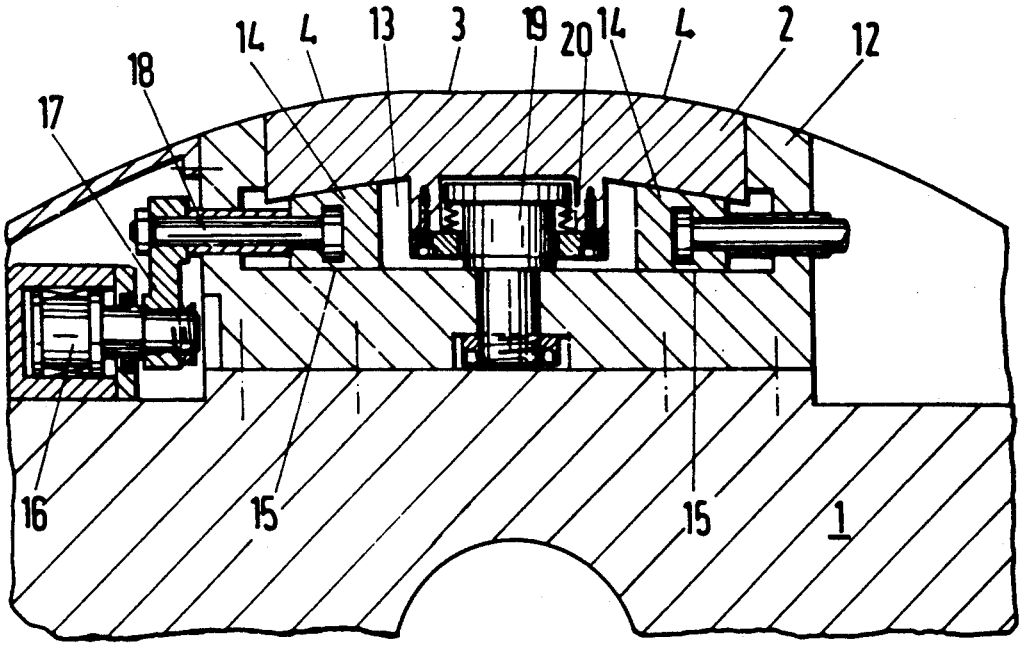
FIG. 2 shows the arrangement of the rolling surface of the invention on segment inserts.

FIG. 2 shows another embodiment of the invention. In this case, the rolling surface 3, 4 is developed on the segment inserts 2 which are inserted in recesses 13 in the rolling segments 12. Each segment insert 2 also is provided on the rear, facing the support body 1, with a wedge surface which rests against a wedge 14 which is displaceable transversely with respect to the direction of movement of the segment insert 2. The wedge 14 rests against the rolling segment 12 within its recess 13 at 15, on the side of the wedge side facing away from the segment 2.

Piston-cylinder units 16 are employed for the displacement of the wedges, one of which is shown on the left-hand side of the drawing. The piston-cylinder unit 16 pulls one of the wedges 14 via a deflection lever 17 and a connecting rod 18, as a result of which, upon synchronous movement of the wedges 14 on both sides, the segment insert 2 is raised and/or lowered. The movement of the segment insert 2 takes place against the action of a spring-supported holding device 19 so that the segment insert 2 is held by means of the springs 20 against the wedge surfaces of the wedges 14.

Figure 3:
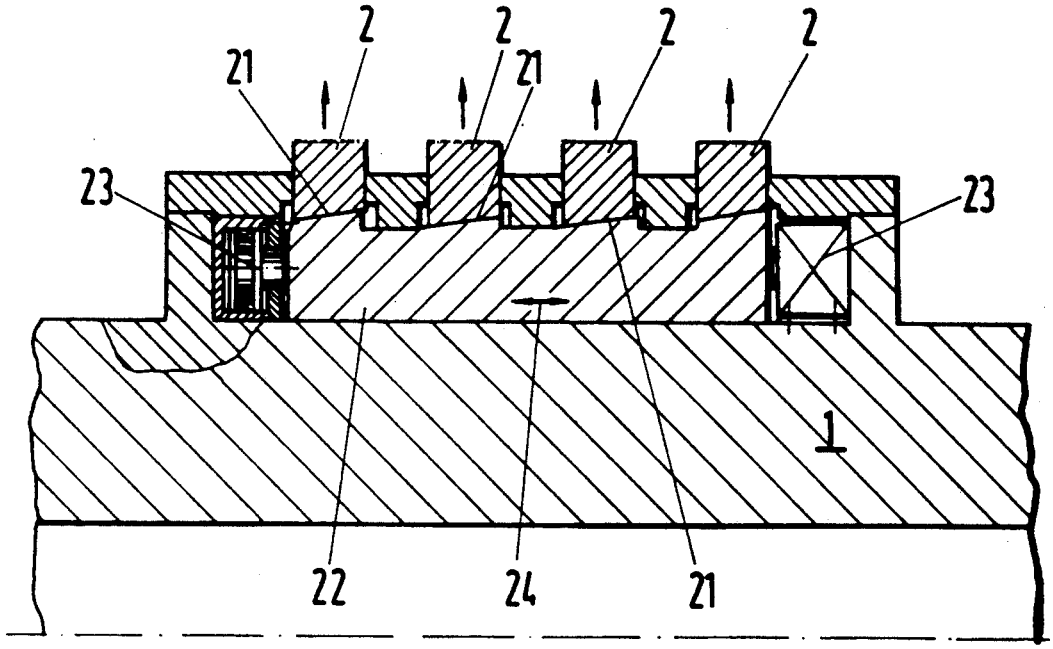
FIG. 3 shows several segment inserts with wedge surfaces arranged one behind the other on a common wedge, the wedge extending transverse to the direction of rolling.

FIG. 3 shows a particularly favorable embodiment of the invention. In this case the support body 1 is now shown in part, in a plane turned at 90°. Several segment inserts 2 lie alongside of each other, and rest in each case with their wedge surfaces 21 against a plurality of wedge surfaces which are associated with the segment inserts 2 and arranged on a common wedge 22. This wedge 22 is displaceable in the direction of movement 24 by means of piston-cylinder units 23, as a result of which the segment inserts 2 can be changed in their vertical position in accordance with the invention. As can be noted from FIG. 3, the wedge surfaces have different inclinations, and the outer wedge surfaces are more strongly inclined than the inner wedge surfaces. In this way, the desired profile of the rolling surface can be determined in advance.

Figure 4:
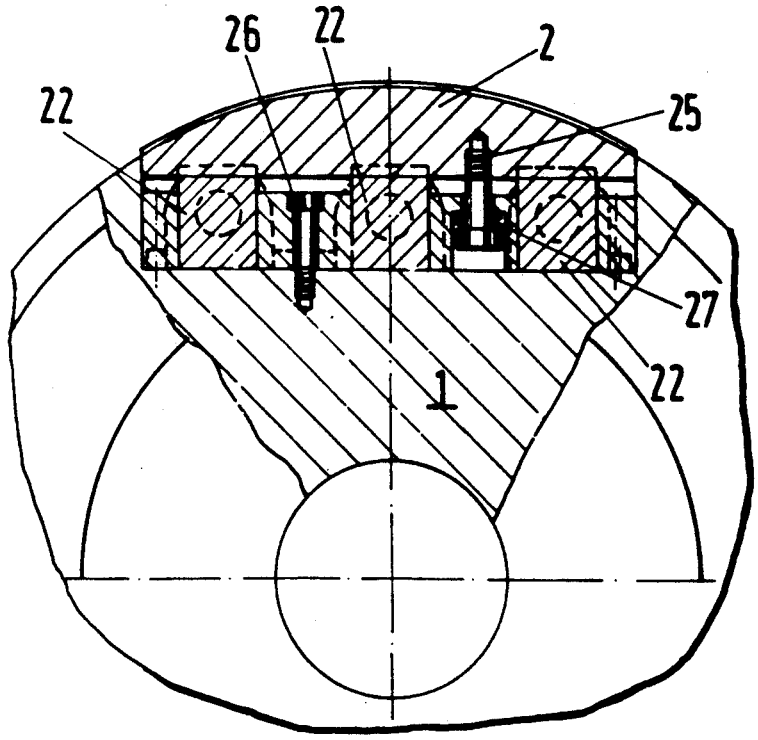
FIG. 4 is a cross section through a rolling segment according to FIG. 3.

FIG. 4 represents a section taken 90° from the plane of FIG. 3, through a segment insert 2, in which connection it can be noted that three wedges 22 are associated in each case with one segment insert 2. The segment inserts 2 are held against the support body 1 as shown by the screws 25 and 26. The change in the vertical position of the segment inserts is possible within the order of magnitude of the spring path of the springs 27.

Figure 5:
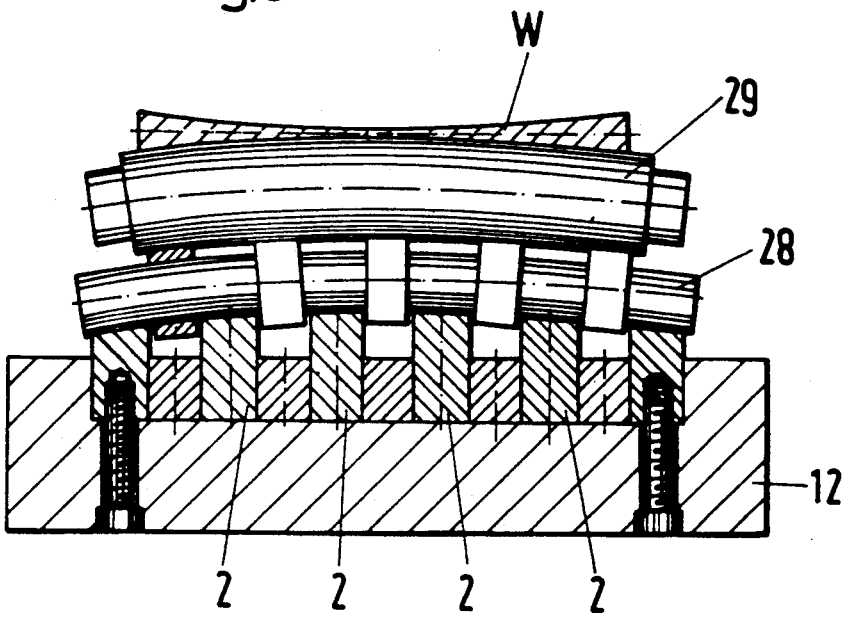
FIGS. 5 and 6 show roll surfaces of convex and concave curvature respectively, in accordance with another embodiment of the invention.

FIG. 5 shows another embodiment of the invention. Since in many cases a given preadjustment of the rolling mill with respect to the rolling surface of the intermediate rolls is sufficient, this embodiment proposes a solution in which the segment inserts are not adjustable. Rather, their surface is machined so as to form a rolling surface for the intermediate rolls. In FIG. 5 the segment inserts are designated 2. The intermediate rolls 28 roll on the segment inserts 2, which sag under the rolling load of the rolling stock W, and as a result of the sag of the work rolls 29, corresponding to the rolling surface formed by the segment inserts 2. As a result of the sag of both the intermediate roll 28 and the work roll 29, the concave cross section of the material being rolled results.

Figure 6:
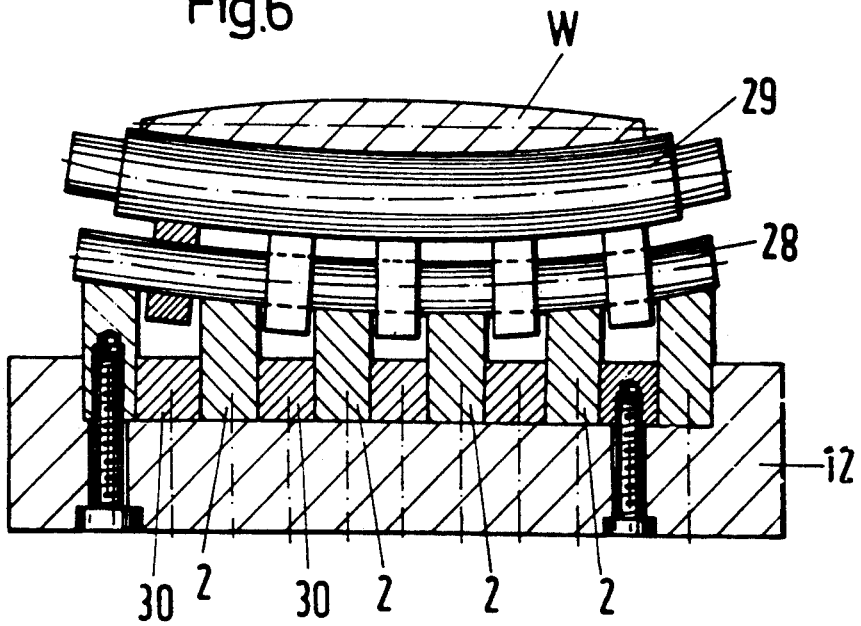

FIG. 6 shows an embodiment which desirably results in a convex cross section of the rolled material, in which the segment inserts 2 are machined as shown. In this embodiment, the support roll or intermediate roll 28 sags in the center so that the work roll 29 which rests against it forms a concave roll nip. By replacement of the segment inserts 2, possibly as a structural unit together with the roll segment 12, the desired sag effect can be changed.

Figure 7:
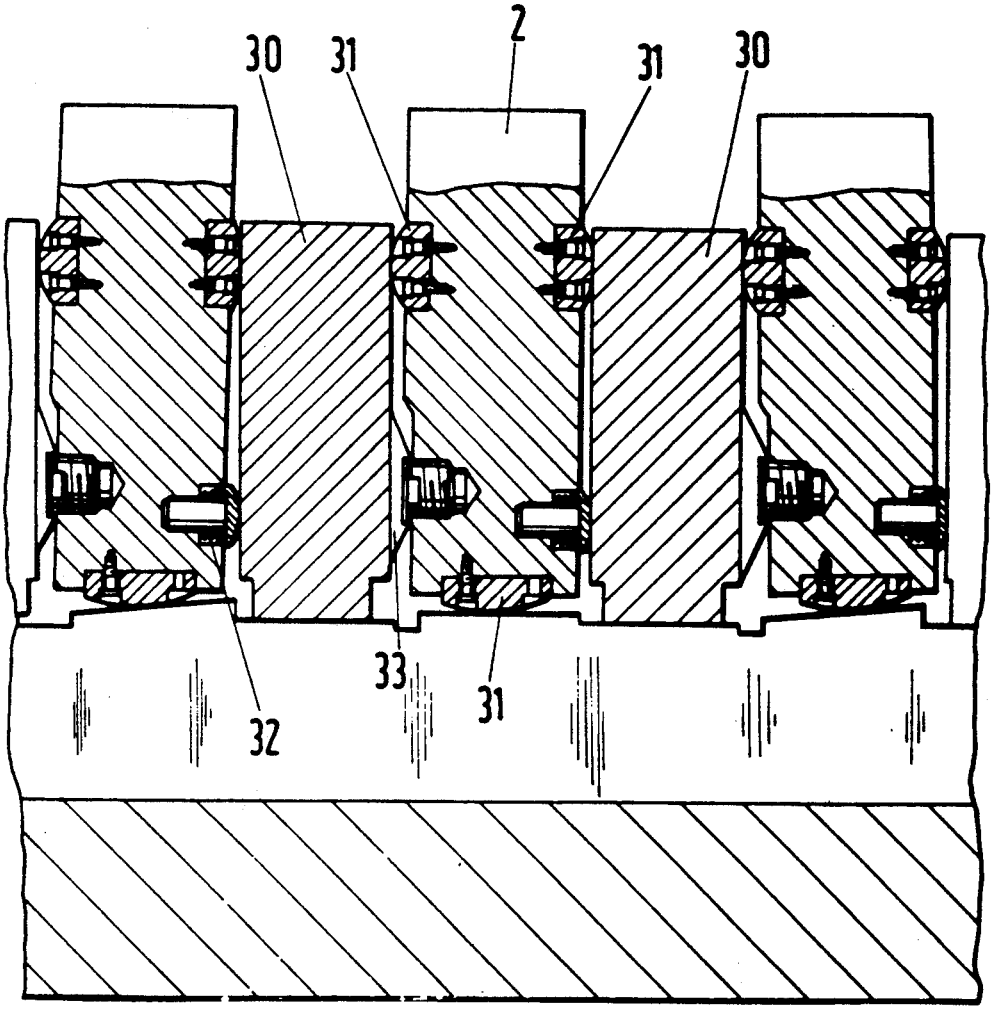
FIG. 7 shows the adjustable mounting of the segment inserts.

In order to make certain that the intermediate rolls 28 rest over their entire surface on the roll surface 3, 4 of the support body, even when the intermediate rolls 28 sag under the rolling load, the segment inserts 2 are mounted for free displacement transverse to the direction of rolling, as shown in FIG. 7. For this purpose, the bottom sides of the segment inserts 2, which rest on the wedge surfaces of the wedges 21, are provided in the same way with barreled inserts 31 as the side flanks of the segment inserts facing the intermediate pieces 30. By means of springs 32, 33, the segment inserts 2 are centered in their central position and can, resting with the lateral barreled inserts 31 against the intermediate pieces 30, come into oblique position against the action of the springs 32, 33, as shown in the case of the segment insert 2 on the right side in FIG. 7.

Figure 8:
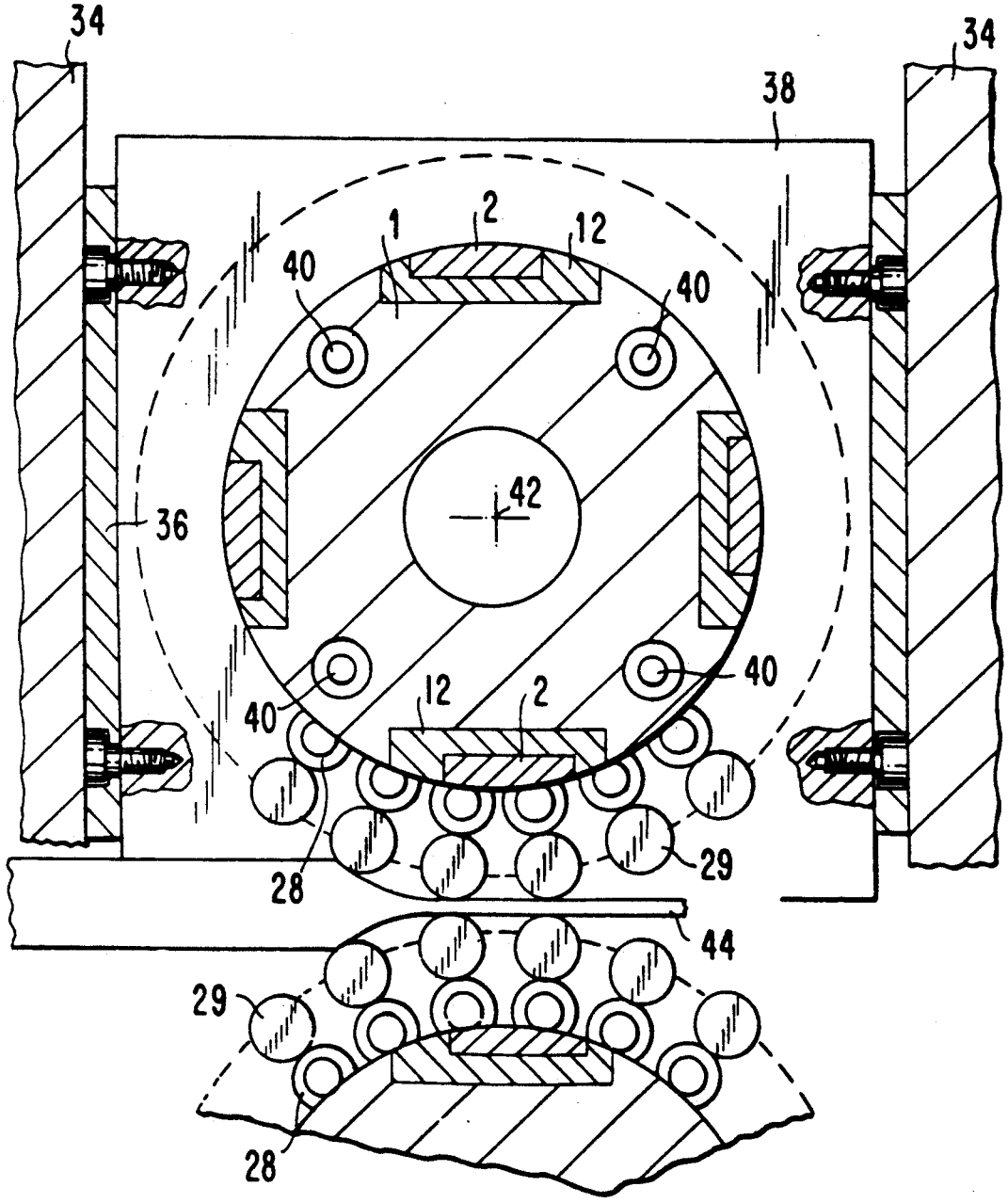
FIG. 8 is a cross sectional view of a planetary rolling mill schematically showing the segment inserts 2 in accordance with the present invention.

FIG. 8 is a cross sectional view of a planetary rolling mill schematically showing the segment inserts 2 in accordance with the present invention. The roll stand which is also known as Platzer roll stand is further described in assignee's co-pending application Ser. No. 573,853 filed Aug. 28, 1990, now U.S. Pat. No. 5,035,131 granted Jul. 30, 1991. As is shown in FIG. 8, support body 1 is mounted via chocks 38 and ledges 36 in roll stand or housing 34. The support bodies are stationary and have an axis indicated at 42. Intermediate rolls or support rolls 28 are arranged around support body 1 in contact with corresponding work rolls 29 for forming a gap therebetween for work piece 44. Clamping devices 40 are arranged for rotating and arresting the support bodies about axis 42 for sequentially bringing rolling segments 12 with corresponding segment inserts 2 into the forming zone. Of course, support body 2 need not have more than one rolling segment but preferably does so as is further set forth in the aforementioned co-pending application.

It should be understood that the preferred embodiments and examples described are for illustrative purposes only and are not to be construed as limiting the scope of the present invention which is properly delineated only in the appended claims.

What is claimed is:

1. A roll stand for a planetary rolling mill comprising:

a housing;

first and second circular support bodies forming a shaping zone therebetween having parallel axes and being mounted within said housing;

at least one rolling segment within said shaping zone of said support bodies;

a plurality of intermediate rolls and a plurality of working rolls mounted for rotation around said first and second support bodies, said intermediate rolls being supported on said rolling segment;

a plurality of hardened segment inserts within said rolling segment, each having a rear side facing said axis of said first of said support bodies and a front surface facing the second of said support bodies, said front surface of said segment inserts forming a rolling surface having a rolling direction and, within said shaping zone, a flattened cross-sectional shape differing from said circular shape of said support bodies; and means at said first of said support bodies for displacing said segment inserts and for displacing at least one of said rolling surfaces relative to said first of said support bodies and in a direction perpendicular to said axes of said support bodies along said rolling direction, comprising a first wedge surface at said rear side of each of said segment inserts and a second wedge surface at said first of said support bodies facing said first wedge surface, said first and second wedge surfaces each having an incline toward a direction and facing one another for sliding displacement against each other along said rolling direction.

2. The roll stand according to claim 1, wherein said displacement means comprises a piston-cylinder unit at both sides of said rolling segment for hydraulically displacing said segment inserts.

3. The roll stand according to claim 1, additionally comprising front and rear ends at said segment inserts as seen in the direction of rolling of said working rolls, said front and rear ends being beveled in planes parallel to said axis of said support bodies and converging toward each other;

a displacement wedge resting against each of said planes for displacing said segment inserts by moving said displacement wedges in alternate directions and for arresting said segments by moving said displacement wedges in the same direction.

4. The roll stand according to claim 1, wherein said rolling segment additionally comprises a recess for receiving said segment inserts therein; and said displacement means comprises hydraulically actuable wedges slidingly engaging said segment inserts for displacing said inserts perpendicularly to said axis.

5. The roll stand according to claim 1, wherein each of said segment inserts comprises a plurality of spaced adjacent wedge surfaces, each wedge surface having an incline, said inclines extending transversely to the direction of rolling; and additionally comprising means for simultaneously moving said wedge surfaces in the same direction.

6. The roll stand according to claim 5, wherein said second wedge surface is formed by a plurality of integrally formed wedge surfaces slidably engaging respective ones of said adjacent wedge surfaces of said segment inserts.

7. The roll stand according to claim 6, wherein said wedge surfaces have different inclines.

8. The roll stand according to claim 1, additionally comprising a central plane extending in the direction of rolling of said intermediate rolls through said rolling surface formed by said segment inserts, said segment inserts being arranged so as to form with respect to said central plane outer segments and inner segments with respective outer wedge surfaces and inner wedge surfaces, said inclines of said wedge surfaces being symmetrical with respect to said central plane, and said inner wedge surfaces and said outer wedge surfaces having the same inclination and direction of inclination.

9. A roll stand for a planetary mill having a rolling direction, comprising:

a housing;

stationary circular opposing support bodies having an axis and defining a shaping zone therebetween and being mounted within said housing;

at least one rolling segment within said shaping zone of said support bodies;

a plurality of intermediate rolls each having a rolling surface and being supported by said support bodies at said rolling segment, and a plurality of working rolls having a direction of rotation, said intermediate rolls and said working rolls being mounted for rotation around said support bodies;

a plurality of hardened segment inserts within said rolling segment, said segment inserts defining a curved rolling surface in contact with at least one of said intermediate rolls, at least one of said segment inserts being displaceable along the rolling direction with respect to said support bodies, so that said rolling surface of said at least one intermediate roll is curved transversely to said direction of rotation of said working rolls.

10. The roll stand according to claim 9, wherein said segment inserts are removable inserts.

11. The roll stand according to claim 9, wherein said segment inserts are adjustably mounted within said rolling segments for movement in the direction of said axis.

* * * * *